US010196825B2

(12) United States Patent
Gosling et al.

(10) Patent No.: US 10,196,825 B2
(45) Date of Patent: Feb. 5, 2019

(54) MODULAR RAISED FLOOR SYSTEM

(71) Applicant: DIRTT Environmental Solutions, Ltd., Calgary (CA)

(72) Inventors: Geoff W. Gosling, Clagary (CA); Mogens F. Smed, DeWinton (CA); Thomas A. Brown, Calgary (CA)

(73) Assignee: DIRTT Enviromental Solutions, Ltd., Calgary (CA)

( * ) Notice: Subject to any disclaimer, the term of this patent is extended or adjusted under 35 U.S.C. 154(b) by 0 days.

(21) Appl. No.: 15/366,709

(22) Filed: Dec. 1, 2016

(65) Prior Publication Data

US 2018/0155935 A1 Jun. 7, 2018

(51) Int. Cl.

| | |
|---|---|
| ***E04F 15/024*** | (2006.01) |
| ***E04B 5/48*** | (2006.01) |
| ***E04F 15/22*** | (2006.01) |
| *E04B 1/94* | (2006.01) |

(52) U.S. Cl.

CPC ..... *E04F 15/02452* (2013.01); *E04B 5/48* (2013.01); *E04F 15/02405* (2013.01); *E04F 15/02458* (2013.01); *E04F 15/225* (2013.01); *E04B 1/94* (2013.01)

(58) Field of Classification Search

CPC ..... E04F 15/02452; E04F 15/225; E04F 15/02458; E04F 15/02405; E04B 1/94; E04B 5/48

See application file for complete search history.

(56) References Cited

U.S. PATENT DOCUMENTS

| | | | | |
|---|---|---|---|---|
| 4,905,437 A * | 3/1990 | Heather | ..... | E04F 15/02494 52/220.3 |
| 5,052,157 A * | 10/1991 | Ducroux | ..... | E04F 15/02411 52/126.6 |
| 6,370,831 B1 * | 4/2002 | Marshall | ..... | E04F 15/02405 52/126.1 |
| 8,181,399 B2 * | 5/2012 | Knight, III | ..... | E04D 11/007 52/126.1 |

* cited by examiner

*Primary Examiner* — Patrick J Maestri

(74) *Attorney, Agent, or Firm* — Workman Nydegger

(57) ABSTRACT

A modular floor system including webbing formed by a plurality of interconnected web sections. The web sections include attachment portions that are aligned in the grid layout. The support members are attachable to attachment sections of the web sections so that attached support members are properly aligned and positioned with respect to one another along the grid layout. The modular floor system includes tiles positioned upon and secured to the support members to be supported above the ground surface by the support members. A utility space is defined by and disposed between the ground surface and the supported tiles. Utility cables can be routed through the utility space.

38 Claims, 10 Drawing Sheets

MODULAR RAISED FLOOR SYSTEM

BACKGROUND

Living spaces, workspaces, offices, restaurants, storefronts, and other architectural spaces typically require flooring to provide desired functional and/or aesthetic features. Typically, flooring is installed over some form of floor structure to provide a more functional, more aesthetically pleasing, or more stable walking surface or surface for placement of furniture, equipment, etc.

However, the installation of flooring can be a lengthy process that requires unique customization to the particular architectural space in which it is being applied. In addition, power cables, data cables, or other infrastructure often needs to be routed to particular positions within the architectural space. Such infrastructure can be positioned over the installed flooring, but this typically creates unsightly effects or must be dealt with using additional structural details.

In some circumstances, such infrastructure can be routed through the ceiling and then routed downward to desired locations. However, ceiling installation can be more difficult and costly. In addition, ceiling installation will often subsequently require additional structural features to route the cables or other infrastructure from the ceiling to the desired locations within the architectural space. This is often undesirable or unsightly. In rooms with very high ceilings, for example, it may be impractical.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Embodiments described herein are directed to modular floor systems and various components, features, and principles that may be utilized in the formation and/or use of modular floor systems. Certain modular floor system embodiments include a plurality of support members configured to be positioned upon a ground surface. The support members extend vertically from the ground surface. In some embodiments, the support members are formed as cylindrical columns configured to structurally support a plurality of overlying tiles interconnected to form the upper surface of the floor. Some embodiments include a webbing extending between each of the support members. The webbing is coupled to the support members to properly space and properly align the support members with respect to one another.

The space disposed between and defined by the tiles and the ground surface may be utilized as a utility space, such as for housing one or more utility cables and/or other infrastructural components. Beneficially, this enables data cables, power cables, and/or other components to be housed and/or routed underneath the upper surface of the floor. This can provide advantages related to aesthetics (e.g., hiding unsightly cables/wires) and/or functionality (e.g., keeping floors free of tripping hazards, enabling desired furniture placement).

In certain embodiments, the webbing is formed by a plurality of interconnected web sections. The web sections may be positioned upon a ground surface to properly align and space the associated support members in a grid layout upon the available ground surface. In some embodiments, the webbing includes one or more web connectors. Each web connector is attachable between two or more adjacent web sections to join the adjacent web sections. When adjacent web sections are joined together, the one or more web connectors have a size and shape that maintains spacing and alignment of the grid layout across the connected web sections.

In some embodiments, the web sections and/or web connectors have a symmetrical configuration that enables the webbing to be started at any location upon the ground surface and expanded from the starting direction in any direction. In some embodiments, the one or more web connectors have a symmetrical square shape with connection points for connecting to separate web sections disposed at each corner of the square shape. In some embodiments, the connectable web sections have an equal width and length, and are configured to provide a grid layout of associated/attached support members with an equal width and length. In one presently preferred embodiment, one or more web sections are configured to align connected support members in a 3×3 grid layout.

In some embodiments, each web section includes a plurality of different connection points each having a different connection type to ensure that adjacent web sections are properly positioned and connected with one another. For example, each web section may include a first connection type at a first corner, a second connection type at a second corner, a third connection type at a third corner, and a fourth corner having three separate connectors for respectively connecting to each of the first, second, and third connection types of corresponding corners of adjacent web sections.

In certain embodiments, at least a portion of the tiles are positioned upon the support members so that each corner of the tile is supported by a support member. In some embodiments, at least a portion of the tiles are arranged upon the members by positioning four corners respectively belonging to four separate adjacent tiles upon an underlying support member and fastening the four adjacent corners to the underlying support member. In certain embodiments, the tiles include corner depressions sized and shaped so that when four corners of four adjacent tiles are brought together upon the underlying support member, the four corners define a countersink for receiving fastening hardware which enables fastening of the tiles to the underlying support member.

Some embodiments described herein relate to a method for constructing a modular floor. In some embodiments, a method includes positioning a plurality of web sections upon a ground surface so that the web sections interconnect with one another to form a grid layout. A plurality of support members are positioned along the grid layout defined by the web sections. The support members are attached to the web members at attachment sections of the web members such that the support members are aligned along the grid layout. The support members extend vertically from the ground surface. In certain embodiments, the method includes positioning a plurality of tiles upon the support members and fastening the plurality of tiles to the support members. The plurality of tiles and the ground surface define a utility space for housing one or more utility cables or other utility or infrastructure components within the modular floor.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Certain embodiments described herein are directed to modular floor systems which can be efficiently installed and which may be utilized to provide functional and/or aesthetic benefits, including eliminating visibility of unsightly cables, providing easy access to hidden cables or other underfloor infrastructure, providing a durable floor surface formed from safe, non-combustible components, and providing a modular surface that can be installed in a custom manner for given floor space needs, for example. In some embodiments, underfloor infrastructure, such as power and/or data cables, may be routed to desired locations in the floor, walls, workstations, etcetera. The ability to install such infrastructure within the floor also reduces or avoids the need to install such infrastructure in ceilings, which requires more difficult installation procedures (e.g., ladder climbing), requires more labor time, and is less safe to install.

Figure 1:
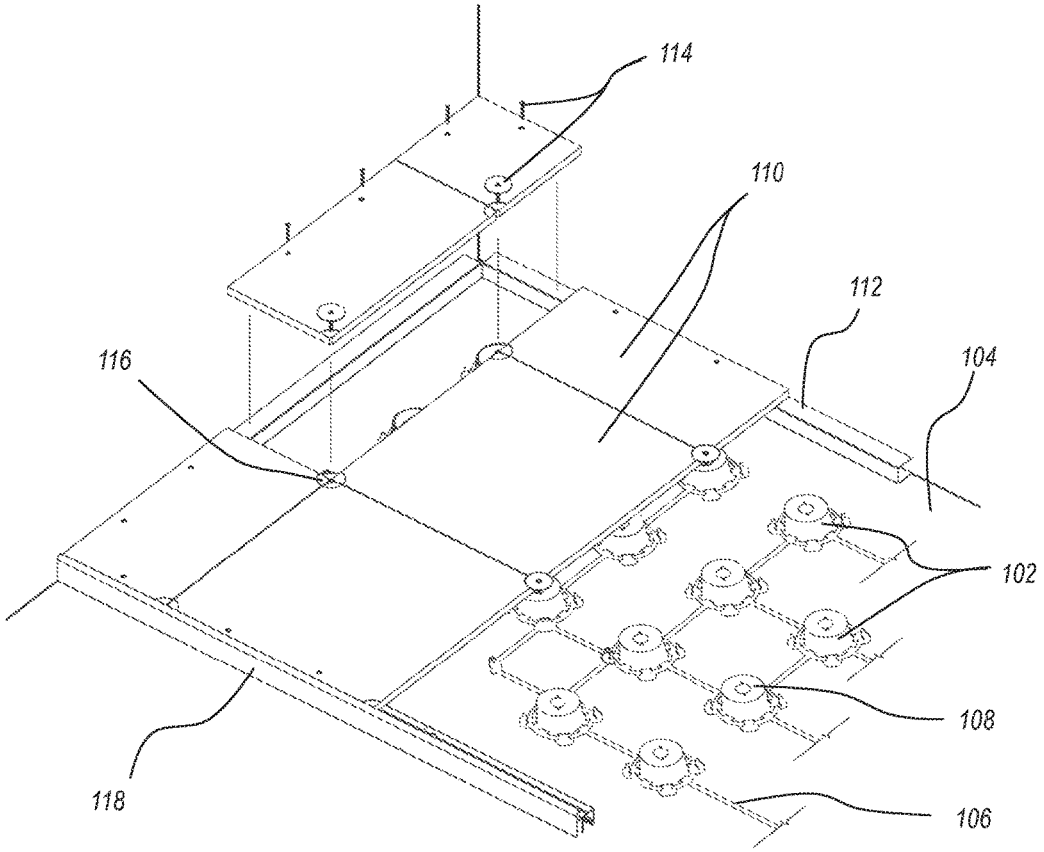
FIG. 1 illustrates an isometric view of a partially assembled modular floor system.

FIG. 1 illustrates an isometric view of a partially assembled modular floor, showing various components that may be utilized to form the modular floor. The particular modular floor section illustrated in FIG. 1 shows installation near a corner of a room where the floor and two perpendicular walls meet. It will be understood, however, that the embodiments and principles described herein may be utilized in a variety of room positions and/or in a variety of room/wall configurations to provide a desired room layout or ground space coverage. For example, some implementations may include installation of a modular floor system in certain areas of a room while omitting installation in other areas. In addition, as explained in more detail below, at least some of the modular floor components described herein can be customized and adjusted during installation to account for structures within the room (e.g., pillars, corners, wall curves, etc.).

FIG. 1 illustrates a plurality of support members 102 arranged on a ground surface 104 upon which the modular floor is to be installed. As shown, the support members 102 are arranged in a grid layout that evenly distributes and spaces the support members 102 across the ground space 104. In presently preferred embodiments, the grid layout of the support members 102 is arranged so that the support members 102 are aligned with one another in rows and columns. For example, a row of support members 102 may be aligned with a selected wall of the room, with columns extending perpendicularly from the rows to form the grid layout, though such rows and columns do not necessarily need to be aligned to a wall of the room. In alternative embodiments, the support members may be otherwise arranged. For example, some embodiments may arrange the support members in an offset pattern, radial arrangement, or other suitable layout.

In the illustrated embodiment, the support members 102 are connected to one another via a webbing 106. As explained in more detail below, the webbing 106 may be utilized to ensure proper spacing and alignment of the support members 102 upon the ground surface 104 (e.g., proper spacing and alignment in the grid layout as described above). The webbing 106 may be configured to space associated support members 102 apart according to design preferences and/or particular application needs. In presently preferred embodiments, the webbing 106 spaces each adjacent support member 102 apart by about 6 to 18 inches, or about 12 inches.

In the illustrated embodiment, each support member is joined to a support pad 108. Each support pad 108 is attached to the upper portion of a corresponding support member 102 such that the support pad 108 is disposed between the support member 102 and any overlying tiles 110.

The support members 102, support pads 108, and webbing 106 may each be made from any material or combination of materials suitable for modular floor system construction. In some embodiments, the support members 102 are formed from or include steel (which may be galvanized or otherwise formed for corrosion protection) or other material having a similar structural integrity and strength for supporting the overlying tiles 110, furniture, foot traffic, etc. In some embodiments, the webbing 106 and support pads 108 are formed from a suitable polymer material, preferably formulated with flame-retardant properties. In one exemplary embodiment, the webbing 106 and support pads 108 are formed from a fire-retardant polypropylene (e.g., V-0 polypropylene). In some embodiments, the support pads 108 are formed from a suitable polymer material capable of functioning as a fastener locking device to resist rotation of fastener hardware 114 out of the installed position.

As shown, one or more tiles 110 may be positioned over and fastened to the arrangement of support members 102 to form the floor surface. The tiles 110 may be formed from any suitable material providing sufficient structural integrity to the tiles for particular application needs. In one exemplary embodiment, the tiles 110 are formed as fiberglass reinforced magnesium oxide boards. The tiles 110 are formed to be cuttable on-site, so that modifications and customizations of the tiles 110 can be made during installation (e.g., at corners, around pillars, for providing access doors, etc.).

In the illustrated embodiment, perimeter blocks 112 are also positioned around the perimeter of the modular floor areas where the modular floor extends to a wall. The perimeter blocks 112 have a height that substantially matches that of the support members 102 (including corresponding support pads 108) so that perimeter tiles extending between a perimeter block 112 and nearby support members 102 can be substantially level with the remainder of the other tiles 110. The perimeter blocks 112 may be formed from steel and/or other suitable materials having sufficient structural integrity for particular application needs.

In the illustrated embodiment, the tiles 110 are attached to underlying support members (and a perimeter block 112 for tiles 110 positioned along the perimeter) using fastening hardware 114. As shown, the tiles 110 include a corner detail formed as a depression. When four separate corners of four respective separate tiles 110 are brought next to one another upon an underlying support member 102, the corner depressions form a countersink 116 for receiving the corresponding fastener hardware 114.

In the illustrated embodiment, the fastener hardware 114 utilized at the countersink 116 and corresponding underlying support members 102 includes a washer and screw assembly for positioning within a formed countersink 116, with the screw extending through to secure to the underlying support pad 108 and support member 102. In the illustrated embodiment, fastener hardware (e.g., screws) utilized along the perimeter to secure tiles 110 to a perimeter block 112 omit corresponding washers. It will be understood that various other fastening components known in the art may be utilized to secure tiles 110 to underlying support members 102 and/or perimeter blocks 112. For example, one or more nails, rivets, bolt and nut assemblies, adhesives, other fastening means, or combinations thereof may be utilized to secure one or more tiles 110 to one or more underlying support members 102 and/or perimeter blocks 112.

The illustrated embodiment also includes a skirt member 118. The skirt member 118 may be utilized to provide a transition from the raised modular floor area to the ground surface 104 or other non-raised region of the floor (see, e.g., the skirt member 118 of FIG. 2 utilized to transition to a carpeted area 125). In some embodiments, the skirt member 118 is an extruded insert configured to fit within and block off the opening between the ground surface 104 and the tiles 110 at the edge where the transition from raised floor to non-raised floor occurs. The skirt member 118 may be formed from aluminum or other suitable material and may be cumulatively aligned piece by piece and/or cut to desired length(s) on site during installation.

Figure 2:
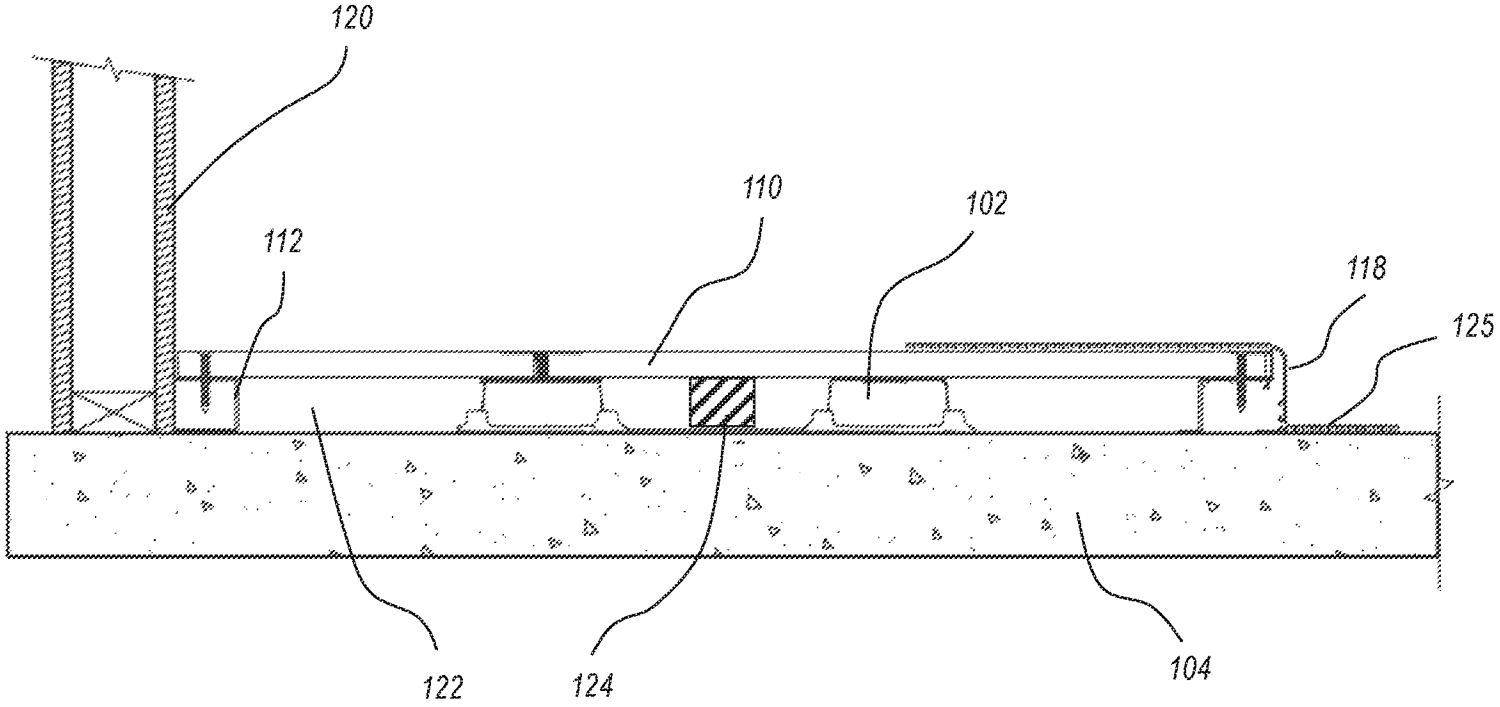
FIG. 2 illustrates a cross-sectional side view of a modular floor system.

FIG. 2 illustrates a cross-sectional side view of an installed modular floor system formed using some of the components of the modular floor system of FIG. 1. As shown in this view, the perimeter block 112 includes an open side positioned to face the wall 120. In this position, the perimeter block 112 includes a bottom horizontal piece providing a surface for gluing to the ground surface 104, a top horizontal piece providing a surface for fastening to overlying tile(s) 110, and a vertical piece positioned to support the overlying tile(s) 110. Positioning the perimeter block 112 with the open side facing toward the wall 120 has been found to minimize materials requirements while also providing sufficient support.

The illustrated configuration of the perimeter block 112 also aids in keeping sharp ends of fastener hardware extending through the perimeter block 112 away from cables or other underfloor infrastructure disposed within a nearby utility space 122. In contrast, a perimeter block positioned with an open side facing away from the wall 120 would provide less effective support (because overlying tile(s) would essentially be resting upon a cantilever/leaf spring) and would not compartmentalize fastener hardware from the nearby utility space 122.

The embodiment illustrated in FIG. 2 also includes a stop 124. The stop 124 may be configured as a draft and/or fire stop, for example. The stop 124 is preferably made from an insulating, moisture resistant, and fire-resistant material. In some embodiments, the stop 124 may be formed from a "mineral wool," such as one including basalt rock, steel slag, other suitable recycled industrial material, or combinations thereof. Although only one stop 124 is shown in the illustrated embodiment, it will be understood that any number of such stops may be utilized according to particular application needs.

The support members 102, tiles 110, and other modular floor components may be sized to provide a utility space 122 that is sized according to particular application needs. In preferred implementations, the utility space 122 provides sufficient space for routing utility cables required for a typical office setting, but is smaller than that which would require airflow or human access throughout. In some embodiments, the utility space 122 has a height (e.g., from the top of ground surface 104 to the underside of tiles 110) of about 0.5 to 5 inches, or about 1 to 4 inches, or about 1.5 to 2.5 inches. In one exemplary embodiment, the utility space has a height of about 1 and 13/16 inches (about 46 mm). Although only one particular utility space 122 is illustrated, it will be understood that any of the spaces underlying the tiles 110 may be utilized as needed and/or desired as a functional utility space.

Figure 3:
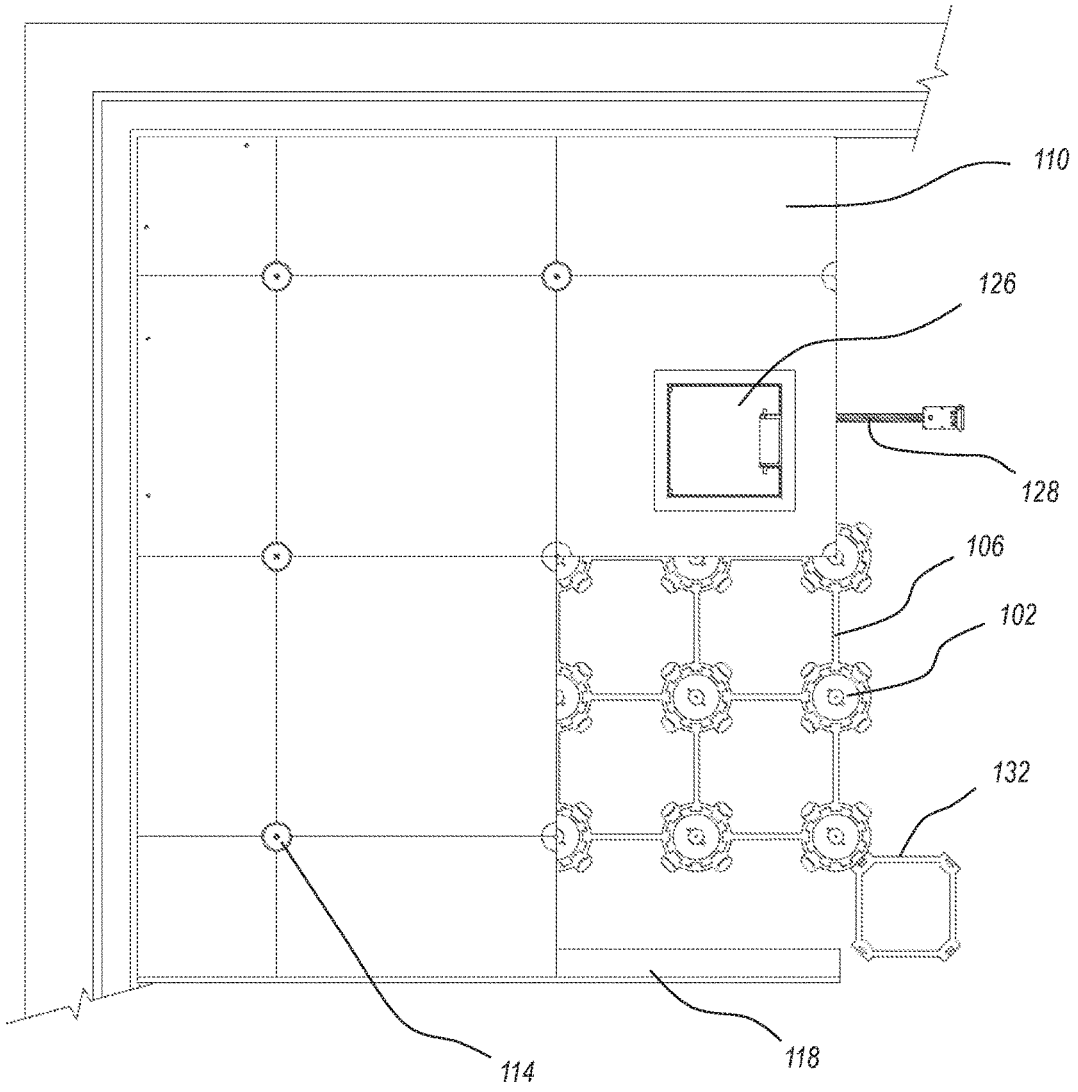
FIG. 3 illustrates a plan view of a partially assembled modular floor system.

FIG. 3 illustrates a plan view of a section of a modular floor installed using some of the components of the modular floor systems of FIGS. 1 and 2. The modular floor embodiment shown in FIG. 3 includes a tile having an access panel 126 for providing access to an underlying utility space. As shown, a utility cable 128 (e.g., power, data) runs underneath the floor, and the illustrated access panel 126 provides access to associated outlets and/or other connections. The access panel 126 may be configured as a hinged door, sliding panel, simple cover plate, or other structure providing selective access to the underlying utility space.

In the illustrated embodiment, the access panel 126 is associated with a utility cable 128. Other embodiments may additionally or alternatively include one or more access panels located to provide access to other desired areas of the modular floor, whether or not those areas are associated with utility cables or utility infrastructure. For example, some areas of the floor may be utilized for storage, for future expansion of power or data cables, and the like. It will be understood that any number of access panels may be installed according to particular application needs.

Tiles 110 are preferably sized to match the grid layout of underlying support members such that tile edges align with a sufficient number of support members and so that a sufficient number of support members are positioned underneath the overlying tiles for support of the tiles. In one exemplary embodiment, the tiles 110 have a length and width of about 24 inches. Tiles of such size will typically be suitable for covering nine support members 102 (eight partially covered along the periphery and one covered by the middle) so as to generally align with the underlying grid layout of the support members 102. Alternative tile embodiments may be cut or sized to cover different sections/sizes of the underlying support member grid layout according to design preferences and/or room configuration requirements. Tile thickness can be selected according to particular application needs and/or according to user preferences. In some embodiments, a tile thickness of about ½ inch to about 1 inch, or about ¾ inch, has shown to provide sufficient structural support while minimizing excessive weight and materials costs.

Figure 4:
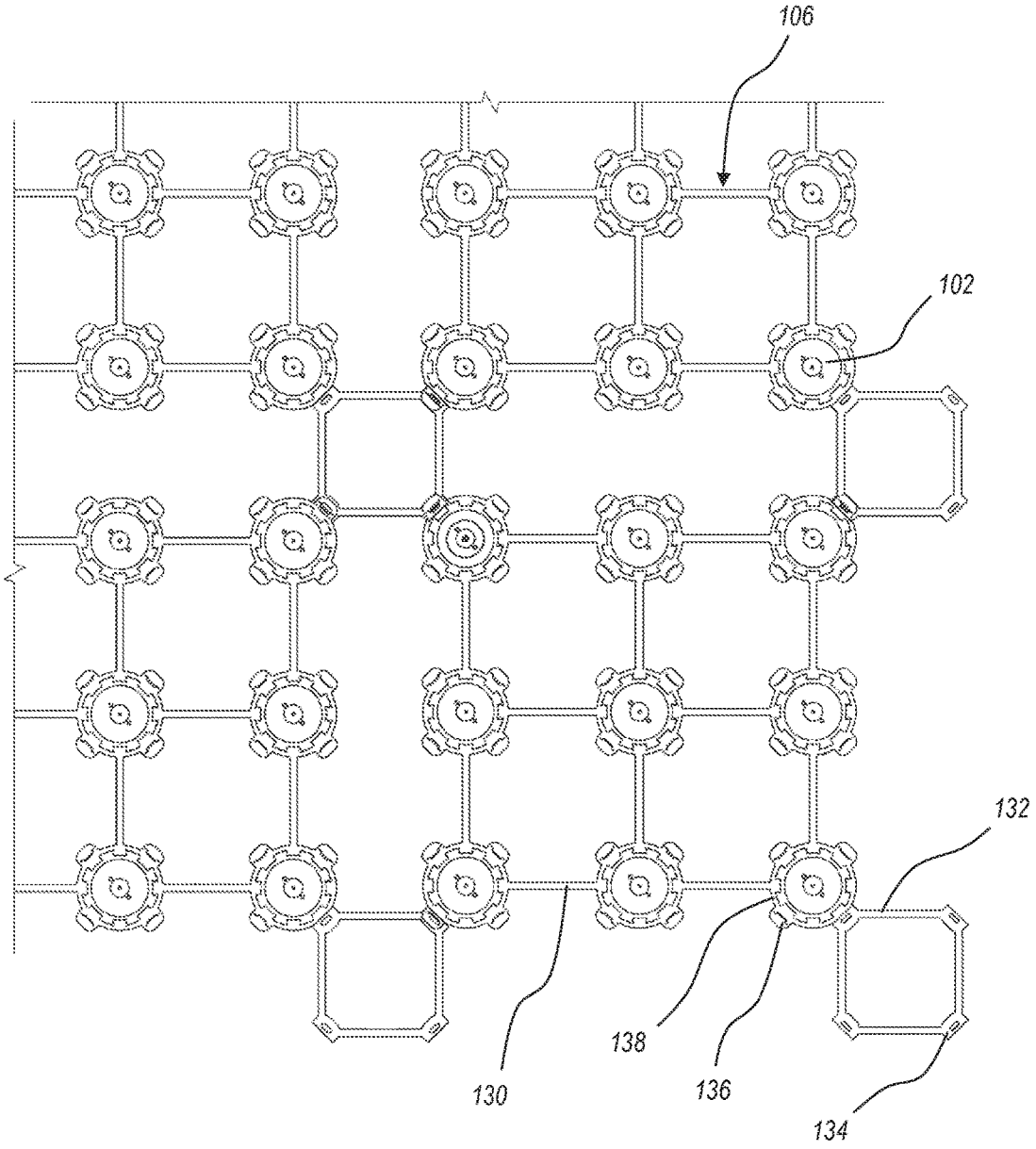
FIG. 4 illustrates an exemplary webbing and support member arrangement that may be utilized in a modular floor system.

FIG. 4 illustrates an exemplary embodiment of a webbing 106, with other modular floor components (tiles, perimeter brackets, etc.) removed to better illustrate the webbing 106. The illustrated webbing 106 is formed from a plurality of web sections 130 and corresponding web connectors 132. As shown, the web sections 130 of this embodiment are utilized to arrange the corresponding support members 102 in a 3×3 grid pattern. It has been found that such a configuration beneficially maximizes the number of support members 102 that can be positioned by each separate web section 130 without being so overly sized as to be unwieldy or to cause handling difficulties. Such a configuration thereby maximizes installation efficiency by minimizing webbing layout time without introducing too many other handling, cutting, or webbing positioning challenges.

Although a 3×3 grid pattern is the presently preferred embodiment, it will be understood that other configurations are also within the scope of this description. For example, a 4×4 web section layout or a 2×2 web section layout may also be utilized in a modular floor system. In some embodiments, a combination of differently sized web sections may be utilized. In addition, although the illustrated embodiment is symmetric in length and width, other web section embodiments may be non-symmetrical (e.g., 3×2, 3×4, etc.). At least some of the web section embodiments described herein are also capable of being cut and adjusted to a desired size prior to installation and/or even on-site during installation. For example, a web section 130 placed near a corner or other floor obstruction may be easily cut so as to remove one or more support member connectors to better conform to the corner or obstruction.

The illustrated web connectors 132 are configured to connect two or more web sections 130 to maintain alignment between the two or more connected web sections 130. As shown, the web connectors 132 are sized and shaped so that when two or more web sections 130 are connected, the grid layout and spacing between adjacent support members 102 is maintained across the connected web sections 130.

The illustrated web connectors 132 have a symmetrical square shape with connection points 134 disposed at each corner. As shown, the web sections 130 include corresponding connection points 136 disposed at each support member ring 138 (the portion of the web section 130 surrounding an associated support member 102). The corresponding sets of connection points 134 and 136 are configured to engage with one another to allow an easy snap on fit. The snap on configuration enables fast and efficient installation. However, alternative embodiments may utilize other connection structures to enable connections by tying, adhesives, fastening hardware, combinations thereof, and the like.

The connection points 136 are spaced around the support member ring 138 at every 90 degrees so that one or more web connectors 132 may be selectively connected to the web section 130 at desired locations. In the illustrated embodiment, each 3×3 web section 130 is connected to a web connector 132 at the corner of the 3×3 grid. Additional web connectors 132 may be placed, as desired, to provide additional structural support and/or to avoid floor obstructions and the like. Preferably, each support member ring 138 includes four connection points 136 symmetrically spaced apart at 90 degrees. In this manner, even those connection points 136 which are not positioned along the regular periphery of the web section 130 are available to enable connections when adjustments or cuts are made to more peripheral portions of the web section 130.

Figure 5:
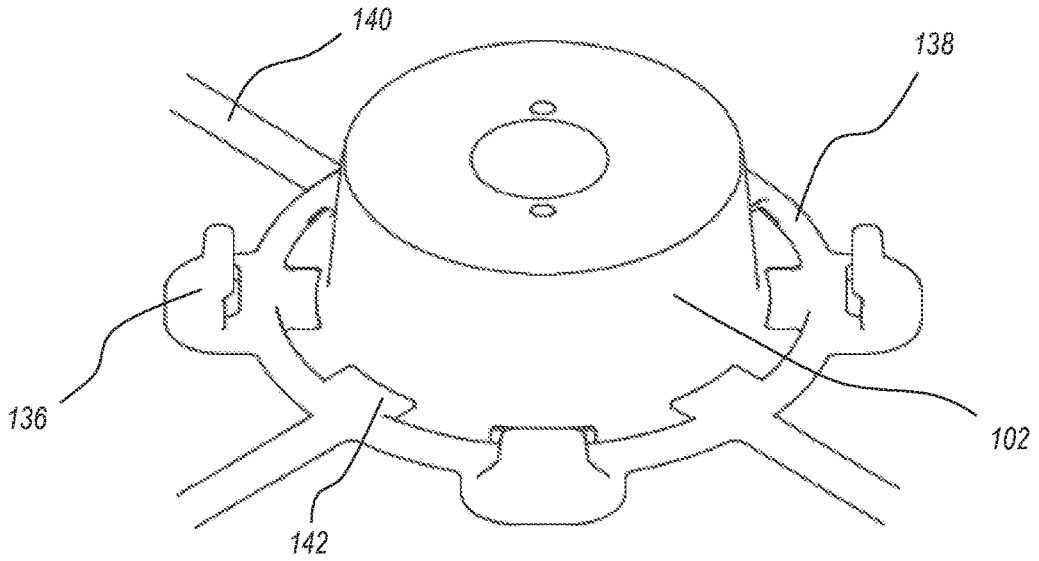
FIG. 5 illustrates a support member and a portion of a support member ring of a web section showing connection points for enabling connecting of other web sections.

FIG. 5 illustrates a detailed view of a support member ring 138 of a web section, showing associated connection points 136. As shown, the connection points 136 are symmetrically spaced from one another by 90 degrees, and are offset from the webbing lines 140 extending from the support member ring 138 by 45 degrees. This configuration positions the connection points 136 at corner positions of the support member ring 136, which enables easy connection to a web connector 132 in a manner which maintains the angular relationships and grid layout spacing of other connected web sections 130 and associated support members 102.

As shown, the illustrated connection members 136 are configured as vertically extending tabs. Each vertically extending tab, in this embodiment, includes a bend that extends radially inwards toward the center of the support member ring 138. This structure allows the connection members 136 to effectively hook and engage with corresponding connection points 134 of a web connector 132 in a snap on manner.

The illustrated support member ring 136 also includes a set of tabs 142 for engaging against an associated support member 102 positioned within the support member ring 136. The support member 102 can include corresponding structure allowing a push on or snap on fit. Additionally, or alternatively, the support member 102 and support member ring 136 can include structure that enables a sufficiently snug fit when positioned together or connected during modular floor assembly.

Figure 6:
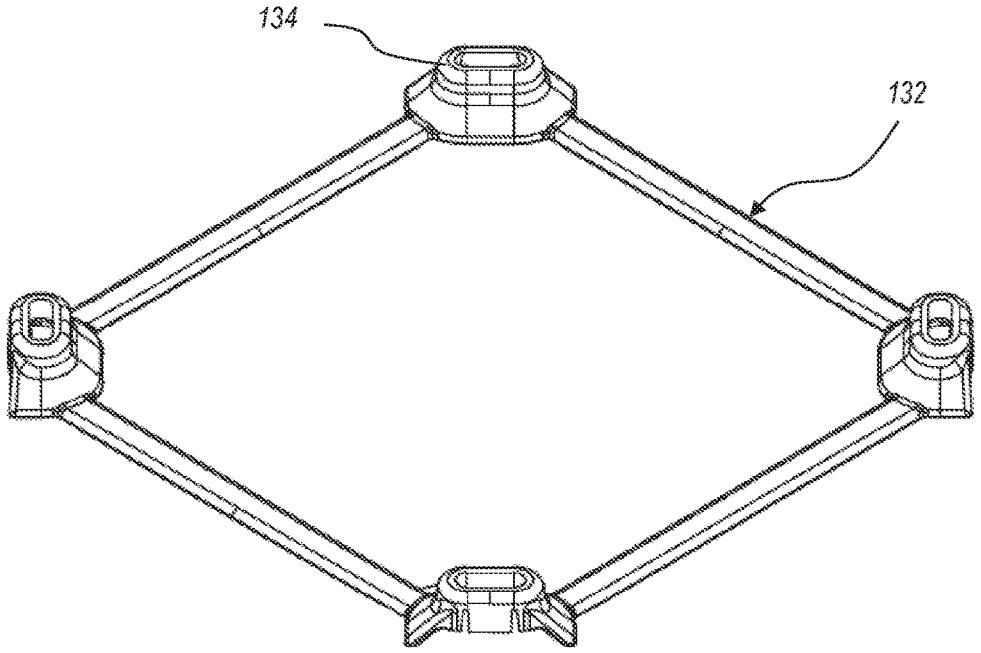
FIG. 6 illustrates an exemplary web connector for connecting two or more adjacent web sections.

FIG. 6 illustrates a detail view of an exemplary web connector 132. In this embodiment, the web connector 132 is configured as a symmetrical square shaped member having connection points 134 disposed at each corner region of the web connector 134. As shown, the connection points 134 include slots that are angularly oriented so as to receive the corresponding structure of connection points 136 in a snap on or push on fitting. Alternative embodiments may reverse the structure (e.g., connection points 136 include slots for receiving tab-like structures of connection points 134) or may utilize alternative fastening means, such as fastening hardware, adhesives, other snap fitting arrangements, or combinations thereof.

Although the foregoing examples are described with structural components substantially utilizing 90 degree angles, 45 degree angles, square shaped web connectors, symmetrical grid layouts, and the like, it will be understood that other angular arrangements may also be utilized (e.g., 30 or 60 degree offsets). Although square grids, square shaped web connectors, and 45 or 90 degree offsets are typically preferred and presently provide for the most efficient installation in a typical room, other angular arrangements may be utilized according to user preferences and/or particular application needs.

Figure 7:
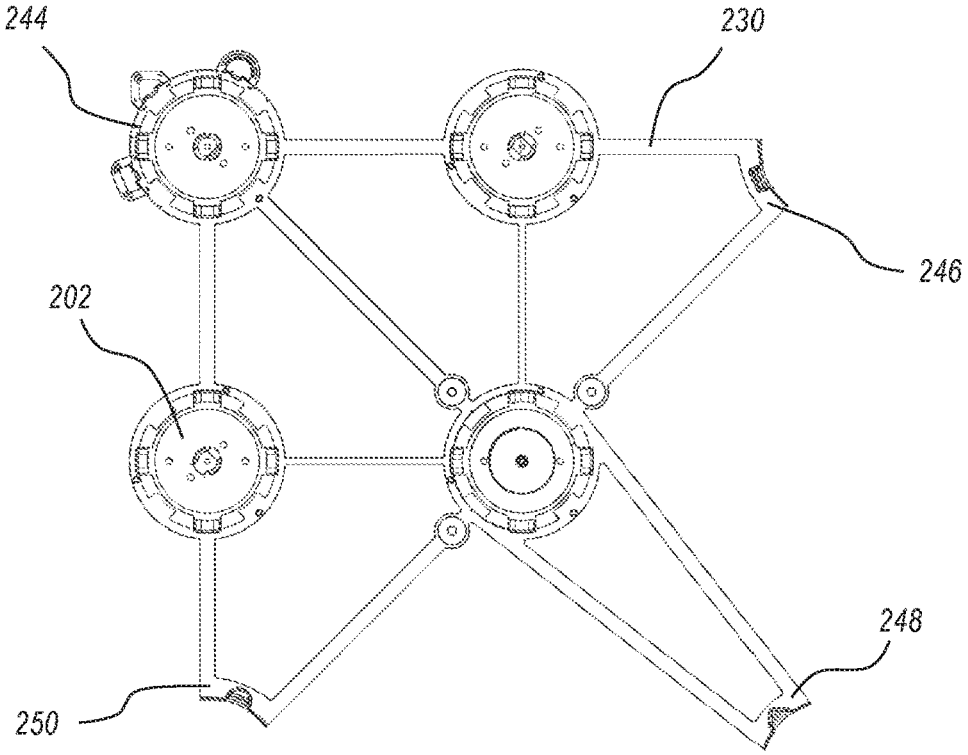
FIGS. 7 and 8 illustrate an alternative web section embodiment having separate connection types and connectors for ensuring proper placement and connection of web sections.

FIG. 7 illustrates an alternative embodiment of a web section 230 which may be utilized with other modular floor system components described herein to form a modular floor. As shown, the illustrated web section 230 is configured to arrange four corresponding support members 202 in a 2×2 arrangement. Other embodiments may include similar features but may be configured for aligning and spacing a different number or arrangement of support members 202 (e.g., 3×3, 2×3, 4×4, etc.).

In the illustrated embodiment, the web section 230 includes a connecting corner 244 formed as a support member ring with three different types of connections. The web section 230 also includes a first corner 246 having a first connection type, a second corner 248 having a second connection type, and a third corner 250 having a third connection type. The different connection types ensure that when web sections are connected together to form an interconnected webbing, adjacent web sections are properly positioned and connected to one another. In the illustrated embodiment, the connecting corner 244 includes the three separate connectors for respectively connecting each of the first, second, and third connection types of corresponding corners of adjacent web sections.

Figure 8:
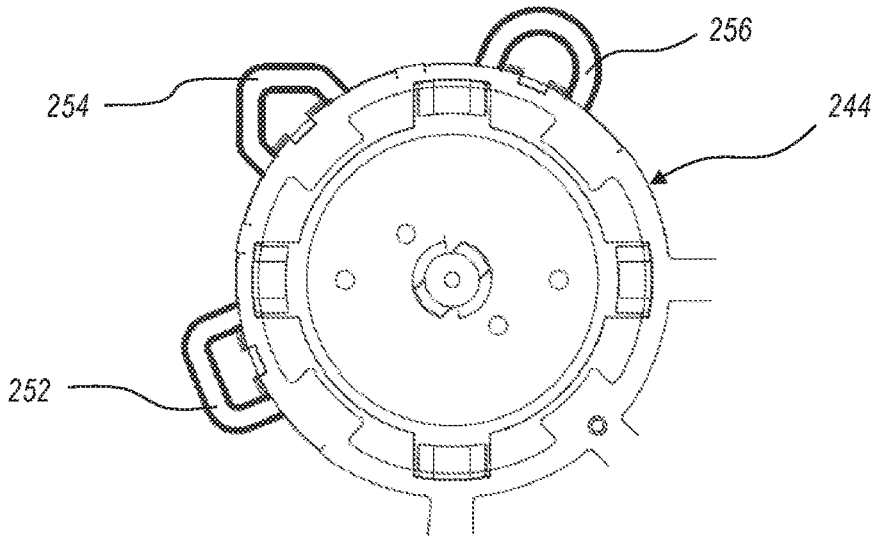

FIG. 8 illustrates a detailed view of the connecting corner 244. As shown, the connecting corner includes a first connector 252 (a square shaped fitting), a second connector 254 (a triangular fitting), and a third connector 256 (a curved fitting). The first connector 252 can be connected to the first corner 246 of an adjacent web section, the second connector 254 can be connected to a second corner 248 of an adjacent web section, and the third connector 256 can be connected to the third corner 250 of an adjacent web section. Although the illustrated embodiment shows square, triangular, and rounded/curved fittings, it will be understood that particular relative positions may be re-arranged and/or that other fitting shapes and types may be utilized. Preferably, however, each separate connector is differently configured so as to only be connectable to a web section corner having a corresponding/mating connection type.

Figure 9:
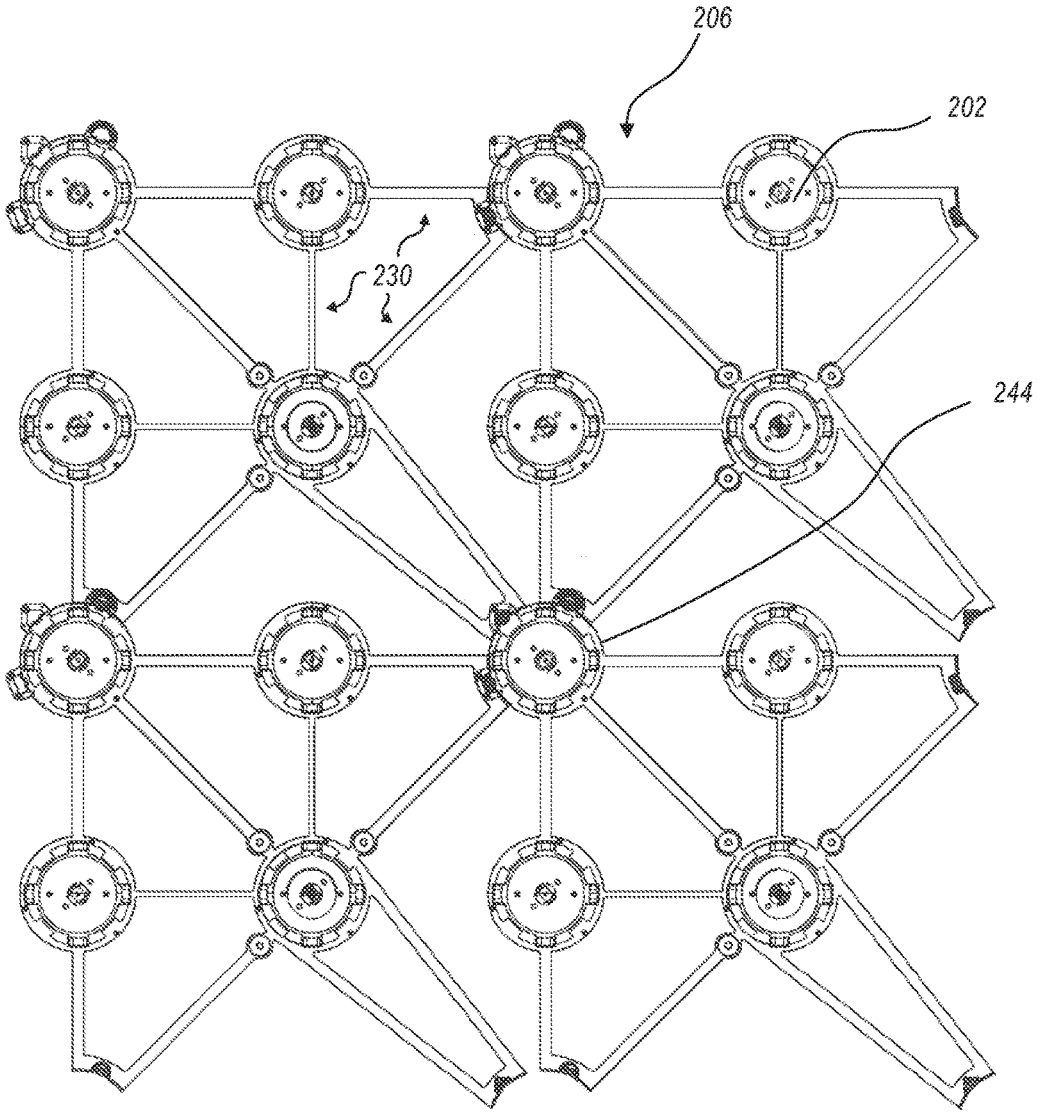
FIG. 9 illustrates a webbing formed by a plurality of the web sections illustrated in FIGS. 7 and 8.

FIG. 9 illustrates a plurality of web sections 230 interconnected to form an interconnected webbing 206. As shown, the individual web sections 230 are arranged so that different corners are connected to corresponding connectors of connecting corners 244. As multiple individual web sections 230 are positioned upon the ground surface, the grid layout of support members 202 is formed.

Figure 10:
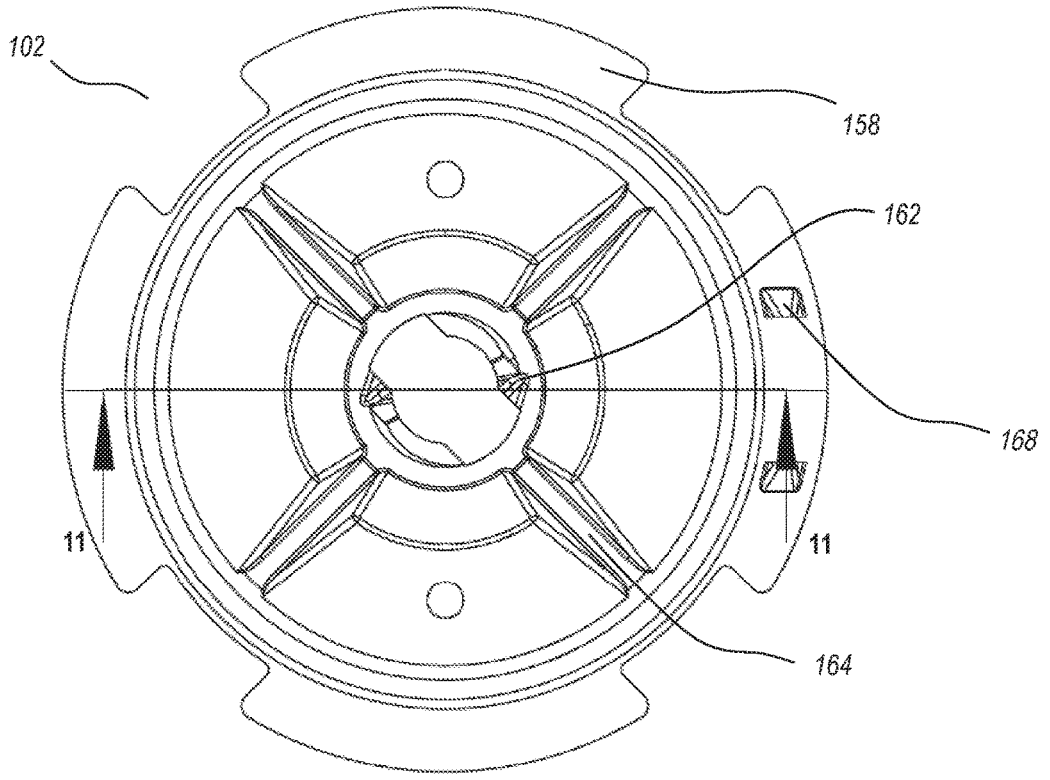
FIGS. 10 and 11 illustrate an exemplary support member.
Figure 11:
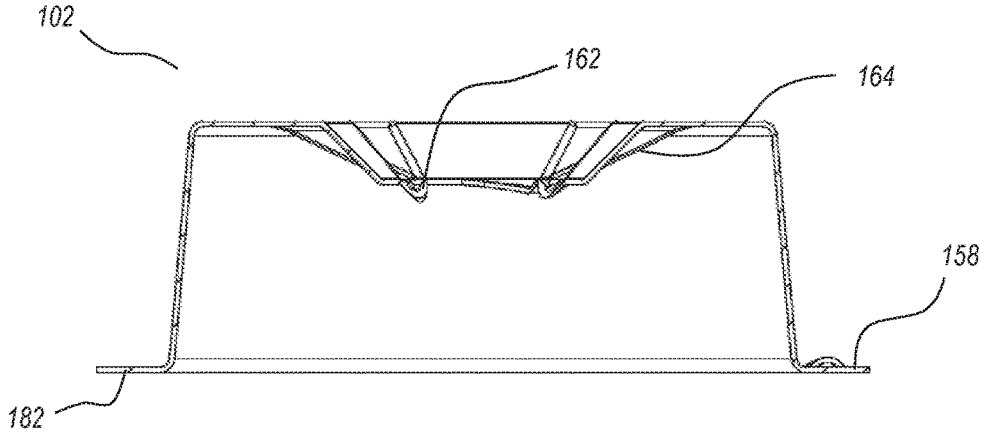

FIGS. 10 and 11 illustrate views of the exemplary support member 102, with FIG. 10 showing a plan view and FIG. 11 showing a cross-sectional side view taken along the line 11-11 of FIG. 10. As shown, the support member 102 includes fins 158 arranged near its base to provide stability and/or to provide structure for engagement with attached webbing. The illustrated support member 102 also includes a receiving area for receiving a support pad. As shown, the receiving area includes an inner bump/groove structure 162 for engaging with corresponding structure of a support pad to properly align the support pad when it is positioned upon the support member 102 and to lock the two parts together (e.g., when the support pad is positioned upon the support member and turned/rotated). The illustrated support member 102 includes outer grooves 164 for structural reinforcement. The illustrated support member 102 also includes a set of connecting tabs 168 for removably attaching the support member 102 to a web section.

The support member 102 may have a height of about 0.5 to 5 inches, or about 1 to 4 inches, or about 1.5 to 2.5 inches. In one exemplary embodiment, the utility space has a height of about 1 and 13/16 inches (about 46 mm). The support member may be sized with a diameter of about 2 to 6 inches, or about 3 to 5 inches, or about 4 inches, with the diameter at the base of the support preferably being greater than at the top by about 1/16 inch to about 1 inch, or about 1/4 inch to 1/2 inch.

The support member 102 includes a bottom surface 182 configured for attachment to the ground surface upon which the modular floor is installed. Such attachment may be carried out using a suitable adhesive, mechanical fastening, and/or other suitable means. Typically, an adhesive provides effective and fast installation without requiring fastener hardware and being effective where fastener hardware is less effective (e.g., concrete floor surfaces).

Figure 12:
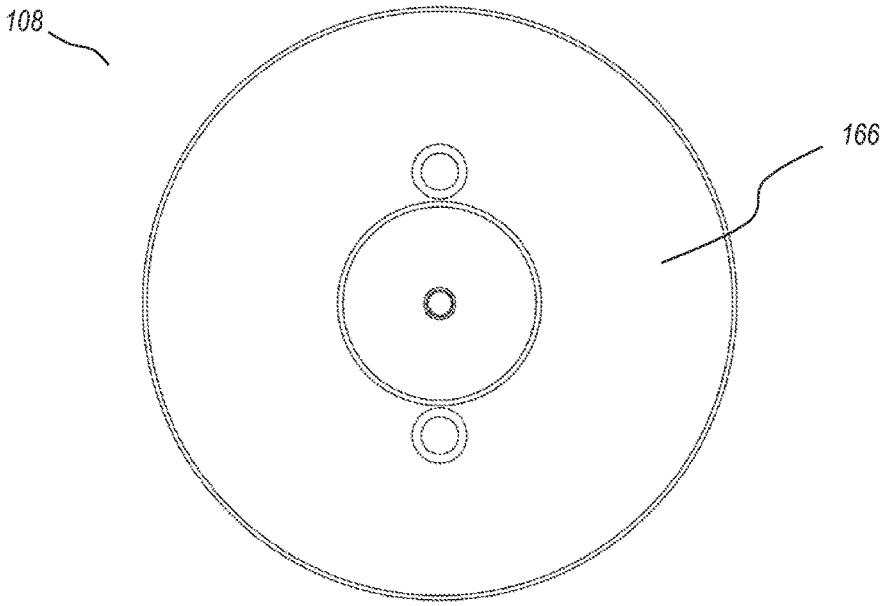
FIGS. 12 through 14 illustrate an exemplary support pad which may be positioned upon a support member to provide padding between the support member and one or more overlying tiles.
Figure 13:
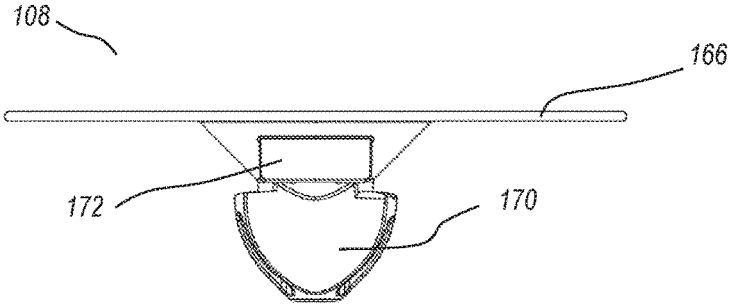
Figure 14:
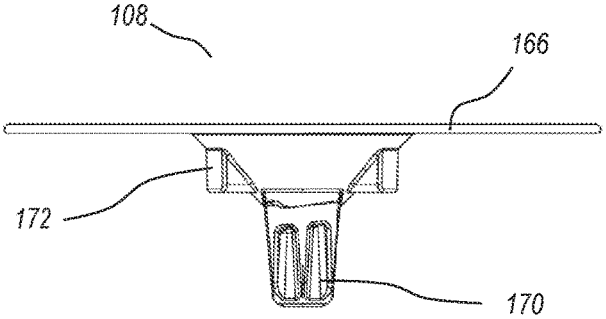

FIGS. 12 through 14 illustrate views of the exemplary support pad 108, with FIG. 12 showing a plan view and FIGS. 13 and 14 showing different side views. As shown, the support pad 108 includes a pad surface 166 and a connecting structure extending downward from the pad surface 166. In the illustrated embodiment, the connecting structure includes an inner extension 170 configured for insertion into a corresponding support member 102 when positioned upon the support member. Outer extensions 172 are configured to rest upon the corresponding support member 102 to support the upper portion of the support pad 108 and to aid in engaging with the steel support member 102.

Figure 15:
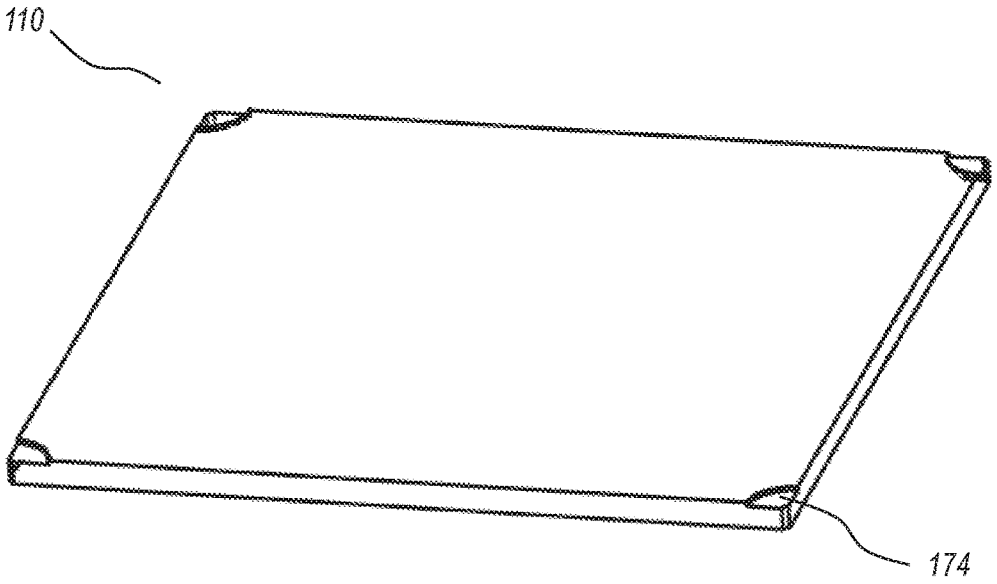
FIG. 15 illustrates an isometric view of an exemplary tile.

FIG. 15 illustrates an isometric view of the exemplary tile 110. As shown, each corner of the tile 110 includes a corner depression 174. The corner depressions 174 are curved so that when four tiles are brought together, the area where four separate corners of the four individual tiles come together forms a circular countersink. The countersink beneficially allows fastening hardware to be applied to fasten the tiles to an underlying support member without extending above the flush surface of the tiles.

Figure 16:
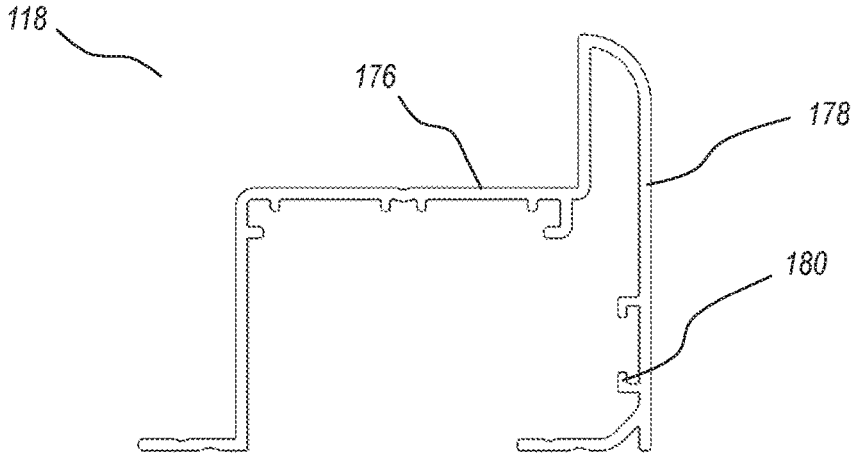
FIG. 16 illustrates cross-sectional view of an exemplary skirt member for providing a transition between a modular floor and the ground surface.

FIG. 16 illustrates a cross-sectional view of the exemplary skirt member 118. The illustrated skirt member 118 includes a support surface 176 for positioning underneath one or more overlying tiles. An outer surface 178 faces outward away from the modular floor and forms the transition from the modular floor to the ground surface adjacent to the modular floor edge. The illustrated embodiment also includes a number of support fins 180 to provide structural stability to the skirt member 118.

The terms "approximately," "about," and "substantially" as used herein represent an amount or condition close to the stated amount or condition that still performs a desired function or achieves a desired result. For example, the terms "approximately," "about," and "substantially" may refer to an amount or condition that deviates by less than 10%, or by less than 5%, or by less than 1%, or by less than 0.1%, or by less than 0.01% from a stated amount or condition. In addition, any stated amount or condition can be considered to be "about" that amount or condition, even if the qualifier is not expressly used.

Elements described in relation to any embodiment depicted and/or described herein may be combinable with elements described in relation to any other embodiment depicted and/or described herein. For example, any element described in relation to individual modular floor system components illustrated in FIGS. 4 through 16 may be utilized in and/or combined with any element described in relation to any of the assembled floor systems described in relation to FIGS. 1 through 3.

What is claimed is:

1. A modular floor system, comprising:

a plurality of support members configured to be positioned upon a ground surface, the support members being configured to extend vertically from the ground surface;

webbing configured to extend between each of the support members, the webbing being coupleable to each support member to properly align and space the support members with respect to one another, the webbing including a plurality of separate connectable web sections;

a plurality of tiles configured to be positioned upon the plurality of support members, the plurality of tiles being configured in size and shape to be supported above the ground surface by the plurality of support members; and a utility space defined by and disposed between the ground surface and the plurality of tiles, at least a portion of the utility space comprising a height of from 0.5 to 5 inches and thereby space to house one or more utility cables;

wherein:

each web section including a plurality of different connection points, and each connection point having a different connection type than another connection point to ensure that adjacent web sections are properly positioned and connected with one another; and each web section includes a first connection type at a first corner, a second connection type at a second corner, a third connection type at a third corner, and a fourth corner having three separate connectors for respectively connecting to each of the first, second, and third connection types of corresponding corners of adjacent web sections.

2. The floor system of claim 1, further comprising a plurality of support pads, each support pad being positioned upon an upper portion of a respective support member to provide padding between the support member and one or more overlying tiles.

3. The floor system of claim 2, wherein the support pads are formed from a polymer material including a fire-retardant additive.

4. The floor system of claim 1, wherein the plurality of support members each have a cylindrical shape that tapers from a base having a larger diameter to an upper portion having a smaller diameter.

5. The floor system of claim 1, wherein each web section has a grid configuration that aligns and positions the respectively connected support members in a grid layout.

6. The floor system of claim 5, wherein the plurality of separate connectable web sections includes one or more web sections with an equal width and length.

7. The floor system of claim 5, wherein the plurality of separate connectable web sections includes one or more web sections configured to align connected support members in a 3×3 grid layout.

8. The floor system of claim 5, further comprising one or more web connectors attachable between two or more adjacent web sections to join the adjacent web sections.

9. The floor system of claim 8, wherein the one or more web connectors have a size and shape such that web sections connected by the one or more web connectors maintain spacing and alignment of the grid layout across the connected web sections.

10. The floor system of claim 9, wherein the one or more web connectors have web connector lines that form a symmetrical square shape with connection points for connecting to separate web sections disposed at each corner of the square shape.

11. The floor system of claim 10, wherein the connection points comprise slots.

12. The floor system of claim 1, wherein at least a portion of the tiles are arranged upon the support members by positioning four corners respectively belonging to four separate adjacent tiles upon an underlying support member and fastening the four adjacent corners to the underlying support member.

13. The floor system of claim 12, wherein the four corners of the four separate adjacent tiles each include a corner depression so that when the four corners are positioned adjacent to one another upon the underlying support member, the four corners define a countersink for receiving fastening hardware.

14. A modular floor system, comprising:

a plurality of support members configured to be positioned upon a ground surface, the support members extending vertically from the ground surface;

webbing formed by a plurality of interconnected web sections, the webbing extending between each of the support members, the webbing being coupled to each support member to properly align and space the support members with respect to one another, in a grid layout, the webbing including one or more webbing connectors disposed between two or more adjacent web sections to join the adjacent web sections, the one or more web connectors having web connector lines that form a symmetrical square shape with connection points for connecting to separate web sections disposed at each corner of the square shape;

a plurality of tiles configured to be positioned upon the plurality of support members, the plurality of tiles being configured in size and shape to be supported above the ground surface by the plurality of support members; and a utility space defined by and disposed between the ground surface and the plurality of tiles, at least a portion of the utility space being configured to house one or more utility cables;

wherein each web section includes a first connection type at a first corner, a second connection type at a second corner, a third connection type at a third corner, and a fourth corner having three separate connectors for respectively connecting to each of the first, second, and third connection types of corresponding corners of adjacent web sections.

15. The floor system of claim 14, wherein the plurality of interconnected web sections includes one or more web sections configured to align the corresponding connected support members in a 3×3 grid.

16. The floor system of claim 14, wherein the one or more web connectors have a size and shape such that web sections connected by the one or more web connectors maintain spacing and alignment of the grid layout across the connected web sections.

17. A method of constructing a modular floor, the method comprising:

positioning a plurality of web sections upon a ground surface;

interconnecting the plurality of web sections with one another to form a grid layout of attachment sections, each web section including a plurality of different connection points, each connection point having a different connection type than another connection point to enable adjacent web sections to be properly positioned and connected with one another, each web section including a first connection type at a first corner, a second connection type at a second corner, a third connection type at a third corner, and a fourth corner having three separate connectors for respectively connecting to each of the first, second, and third connection types of corresponding corners of adjacent web sections;

positioning a plurality of support members along the grid layout defined by the web sections, the support members being attached to the web members at the attachment sections of the web members such that the support members are aligned along the grid layout, the support members extending vertically from the ground surface;

positioning a plurality of tiles upon the support members and fastening the plurality of tiles to the support members, the plurality of tiles and the ground surface defining a utility space therebetween for housing one or more utility cables;

wherein:

one or more of the plurality of support members are fixed to the ground surface;

the plurality of support members defines a utility space between the ground surface and the plurality of tiles, the utility space thereby configured to house one or more utility cables.

18. The method of claim 17, wherein one or more of the plurality of support members are fixed to the ground surface by an adhesive.

19. The method of claim 17, further comprising positioning a plurality of support pads upon an upper portion of a respective support member to provide padding between the support member and one or more overlying tiles.

20. The method of claim 17, wherein:

the plurality of support members each has a cylindrical shape that tapers from a base having a larger diameter to an upper portion having a smaller diameter; and each web section has a grid configuration that aligns and positions the respectively connected support members in a grid layout.

21. The method of claim 20, wherein the plurality of web sections includes one or more web sections with an equal width and length.

22. The method of claim 17, further comprising:

attaching one or more web connectors between two or more adjacent web sections to join the adjacent web sections;

wherein:

the one or more web connectors have a size and shape such that web sections connected by the one or more web connectors maintain spacing and alignment of the grid layout across the connected web sections;

the one or more web connectors have web connector lines that form a symmetrical square shape with connection points for connecting to separate web sections disposed at each corner of the square shape.

23. The method of claim 17, further comprising:

arranging at least a portion of the tiles upon the support members by positioning four corners respectively belonging to four separate adjacent tiles upon an underlying support member; and fastening the four adjacent corners to the underlying support member.

24. The method of claim 23, wherein:

the four corners of the four separate adjacent tiles each include a corner depression; and positioning the four corners adjacent to one another upon the underlying support member to define a countersink for receiving fastening hardware.

25. The floor system of claim 1, wherein one or more of the plurality of support members are fixed to the ground surface by an adhesive.

26. The floor system of claim 14, wherein one or more of the plurality of support members are fixed to the ground surface by an adhesive.

27. The floor system of claim 14, further comprising a plurality of support pads, each support pad being positioned upon an upper portion of a respective support member to provide padding between the support member and one or more overlying tiles.

28. The floor system of claim 27, wherein the support pads are formed from a polymer material including a fire-retardant additive.

29. The floor system of claim 14, wherein the plurality of support members each have a cylindrical shape that tapers from a base having a larger diameter to an upper portion having a smaller diameter.

30. The floor system of claim 14, wherein each web section has a grid configuration that aligns and positions the respectively connected support members in a grid layout.

31. The floor system of claim 30, wherein the plurality of separate connectable web sections includes one or more web sections with an equal width and length.

32. The floor system of claim 30, wherein the plurality of interconnected web sections includes one or more web sections configured to align connected support members in a 3×3 grid layout.

33. The floor system of claim 30, further comprising one or more web connectors attachable between two or more adjacent web sections to join the adjacent web sections.

34. The floor system of claim 33, wherein the one or more web connectors have a size and shape such that web sections connected by the one or more web connectors maintain spacing and alignment of the grid layout across the connected web sections.

35. The floor system of claim 34, wherein the one or more web connectors have web connector lines that form a symmetrical square shape with connection points for connecting to separate web sections disposed at each corner of the square shape.

36. The floor system of claim 35, wherein the connection points comprise slots.

37. The floor system of claim 14, wherein at least a portion of the tiles are arranged upon the support members by positioning four corners respectively belonging to four separate adjacent tiles upon an underlying support member and fastening the four adjacent corners to the underlying support member.

38. The floor system of claim 37, wherein the four corners of the four separate adjacent tiles each include a corner depression so that when the four corners are positioned adjacent to one another upon the underlying support member, the four corners define a countersink for receiving fastening hardware.

* * * * *